United States Patent [19]

Blanco et al.

[11] 4,403,442

[45] Sep. 13, 1983

[54] EXTENDABLE NAILS FOR DOLLS

[76] Inventors: Josephine Blanco; Jeanne M. Blanco, both of 2460 Brice Rd., Akron, Ohio 44313

[21] Appl. No.: 311,199

[22] Filed: Oct. 14, 1981

[51] Int. Cl.[3] ..... A63H 3/36

[52] U.S. Cl. ..... 46/163; 434/267

[58] Field of Search ..... 46/163, 135 R, 156; 434/267

[56] References Cited

U.S. PATENT DOCUMENTS 3,691,679 9/1972 Kersten ..... 46/163

*Primary Examiner*—F. Barry Shay

*Attorney, Agent, or Firm*—Oldham, Oldham, Hudak, Weber & Sand Co.

[57] ABSTRACT

A doll having extendable fingernails and toenails. Unexposed lengths of the nail extend into the hollow portions of the doll's body. The nails, held in place by grooves on either side of said finger or said toe, are extended by the use of slight outward pressure or the use of electromechanical means. In such manner, new nail surface may be exposed and the old surface cut away. This permits the manicure and painting of the nails, generation of a new nail surface, and the subsequent removal of old nail surface by trimming of the nail or otherwise.

8 Claims, 8 Drawing Figures

EXTENDABLE NAILS FOR DOLLS

TECHNICAL FIELD

The invention herein lies in the art of novelty device for dolls. Specifically, the invention relates to a device for simulating the growth of fingernails and toenails through the use of extendable nail material stored within the body of the doll. The device permits the child to manicure and paint the exposed nails, to generate a new nail surface, and thereby repeat the process.

BACKGROUND ART

The prior art in this field is highly populated, owing in great measure to the enduring popularity of dolls in general. Indeed, civilization has accepted the use of dolls as playthings and show pieces for thousands of years. However, the irresistable onslaught of technology spares neither man nor his mechanical minions, not even his dolls. What wonderment would behold in the child of antiquity with the sight of a doll possessing disposable hands and feet (U.S. Pat. No. 2,896,372), hair that grows (U.S. Pat. No. 3,101,557) or hands that grasp (U.S. Pat. No. 3,071,893)? What delight to dress a doll having interchangeable clothing (U.S. Pat. No. 2,331,776), or other elements (U.S. Pat. No. 1,075,482)? The list goes on (U.S. Pat. Nos. 2,453,604; 2,908,449; 2,739,417). Ingenuity abounds. Yet what further marvels could man visit upon his younger kinfolk? The answer lies hereinbelow.

DISCLOSURE OF INVENTION

In light of the foregoing, it is an object of the instant invention to provide a doll having fingers and toes with extendable nails.

Another object of the instant invention is to provide a doll having extendable nails which may be painted or manicured.

A further object of the instant invention is to provide a doll having extendable nails the ends of which may be cut off, thus generating a new exposed nail surface.

The foregoing and other objects of the invention which will become apparent as the detailed description proceeds are achieved by: a doll, the fingers and toes of which contain tracks whereon are located lengths of nail material which extend into the hollow body of the doll.

BRIEF DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 1:
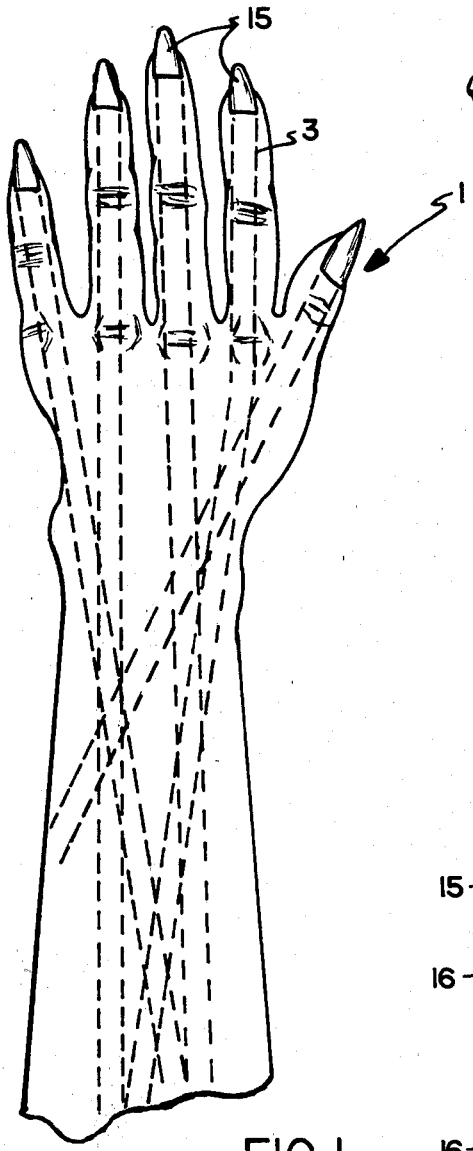
FIG. 1 is a top view of a doll hand showing the internal orientation of the nail material.

Referring now to the drawings and more particularly to FIG. 1, it is noted that a doll's hand is designated generally by the number 1. The nail material 3, extending into the hollow interior of the doll's hand and arm, terminates in the exposed nail 15.

Figure 2:
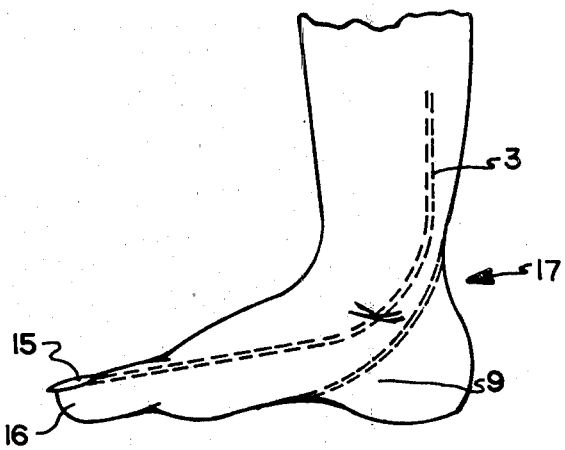
FIG. 2 is a side view of a doll foot showing the nail material and arcuate surface which guides the same.

Turning now to FIG. 2, it is seen that a doll's foot is designated generally by the number 17. The nail material 3, as in the doll's arm and hand, extends down from the doll's leg into the foot and terminates as the exposed nail 15 in the toe 16. An arcuate surface 9, in the interior of the doll's heel, guides the nail material 3 up into the hollow leg of the doll when the nail material is inserted prior to use.

Figure 3:
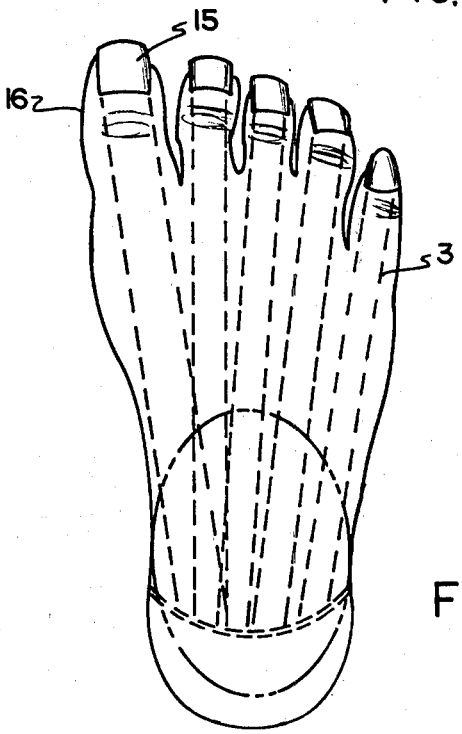
FIG. 3 is a top view of the doll's foot showing the nail material and the arcuate surface.

FIG. 3 shows a top view of the doll's foot. It is seen that the nail material 3, guided by the artucate surface 9, culminates in the exposed nail 15.

Figure 4A:
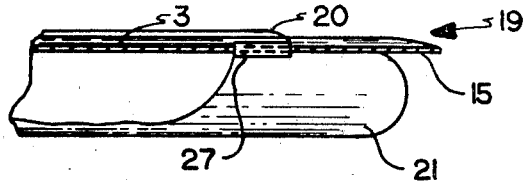
FIG. 4*a* is an end sectional view of a toe or finger, showing the nail tracks and the exposed nail.
Figure 4B:
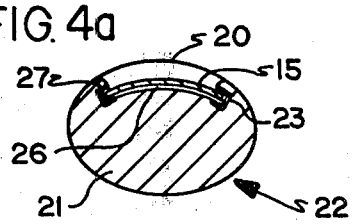
FIG. 4*b* is a side sectional view of a finger according to the invention.

FIGS. 4(*a*) and 4(*b*) represent respectively a side view 19 and a cross-sectional end view 22 of the doll's fingers. It will be appreciated that the toe is of similar construction. The fingertip 21 is solid, said solid construction serving the purpose of support for the nail tracks 23 and 27. The nail tracks, and consequently the solid construction of the fingertip 21, may extend past the cuticle 20 to the length necessary for said tracks to perform their function of securing and properly aligning and registering the nail material 30 and exposed nail 15.

The nail tracks 23 and 27 may be of integral construction with the fingertip 21 or may be of different material but adhesively secured thereon. In a like manner, the cuticle 20, which also aids in securing the nail material 30 by pressing downward upon said nail material, may be of integral or separate construction with that of the fingertip 21. It is understood however, that in any event construction of the finger (or toe) represents an appealing, unified appearance consistent with the flesh tones of the doll as a whole.

Figure 5:
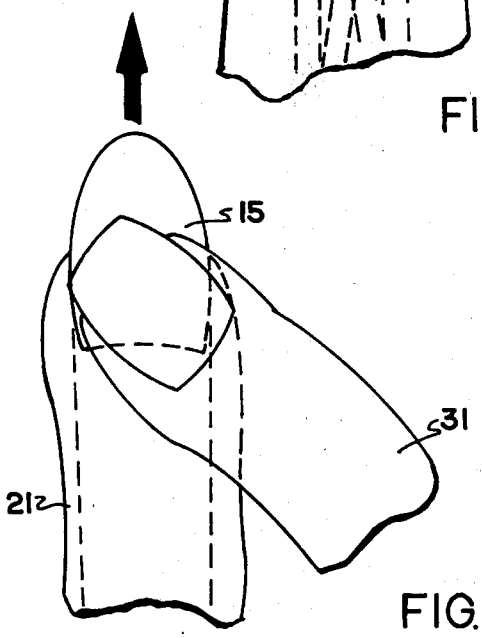
FIG. 5 depicts the nail material being extended.

The method of extension of the nail is shown in FIG. 5. The nail material 25 is extended outward from a finger or toe 21 by means of slight pressure and outward movement exerted by the child's finger 31.

Alternatively, of course, the nail 15 may be drawn forward by grasping of the tip and exerting a pulling force on the nails.

Figure 7:
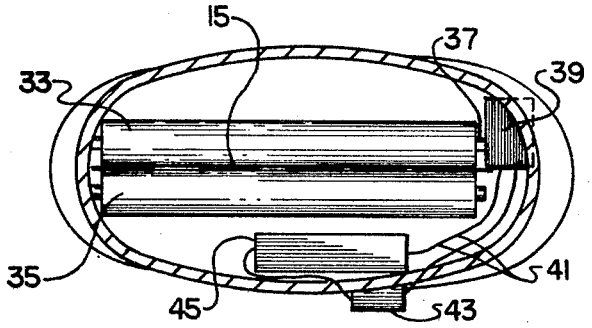
FIG. 7 is a cross-sectional view of a doll's hand showing details of the mechanical nail extender.
Figure 6:
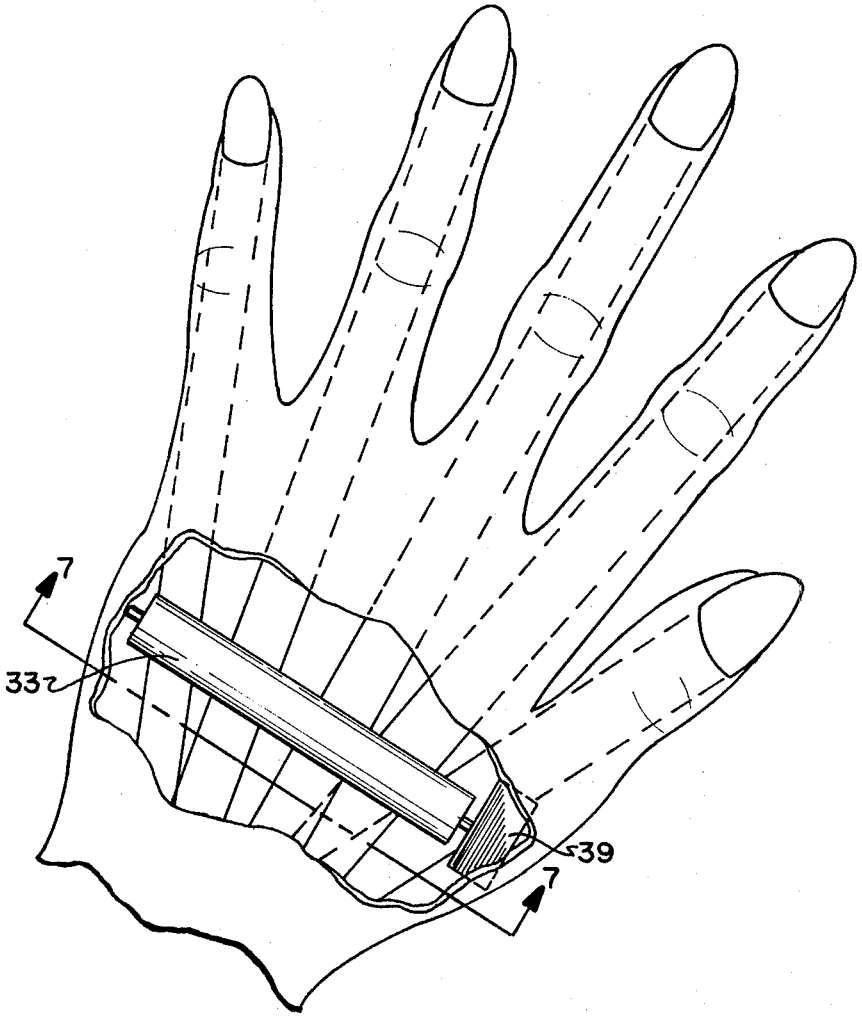
FIG. 6 is a top view of a doll's hand showing the mechanical nail extended.

If desired, extension of the nail can be performed by mechanical means as shown in FIGS. 6 and 7. Here nail material 15 is drawn through drive roller 33 and idler roller 35. Drive roller 33 is driven by electric motor 39 through motor shaft 37. Electrical wires 41 connect motor 39 to switch 43 and battery 45. The switch may be conveniently located in the palm of the doll's hand.

Rollers 33 and 35 are constructed of material such as rubber having a high degree of friction resulting in a firm grip upon the nail material 15. Said rollers are secured to the inside wall of the doll's hand in well known fashion.

Motor 39, switch 43 and battery 45 are of well known design representing the current state of the art in miniaturized electrical components. Battery 45 is commonly that utilized in such devices as cameras and small toys.

It is appreciated that the above-described mechanical means applies equally to the feet of the doll, that is, the toe nail may also be extended mechanically-wise.

Further, it is contemplated that each nail may have its own means for electro-mechanical extension, that is, each finger or toe may have its own set of pinch rollers, motor and switch. A battery may then drive a plurality of such motors or each motor may have a separate battery.

The battery 45 need not be positioned within the hand or foot as shown in FIG. 7. Said battery may indeed be located in the thorax or head of said doll (not shown) or, if small enough, within said hand or said foot of said doll. This versatility of placement applies equally well if a plurality of batteries are used.

The nail material 3 may be constructed of any suitable material imparting a life-like quality to the fingers and toes of the doll. This includes, by way of example, various synthetic polymers having physical properties similar to that of human cutaneous material. In addition to its physical appearance, the nail material 3 should be soft enough to allow the child to easily manicure and paint the exposed nail 15. Should the child then desire to repeat the process with a new exposed nail 15, he or she merely exposes a new section of the nail material 3 by pressing the exposed nail 15 down and outward. The old nail may then be trimmed off.

When the nail material 3 has been used up, a replacement piece of nail material 3 may be inserted by the reverse process of extending the nail material 3. That is, the replacement nail material 3 is inserted into the grooves or tracks 23 and 27 of the finger or toe and extended up into the hollow area of the hand or foot respectively.

When inserting replacement nail material 3 into the toe 16, the arcuate surface 9 guides the nail material 3 up into the leg of the doll.

The nail tracks 23 and 27 may be an integral part of the fingers and toes of the doll, or they may be of separate manufacture and consequently of separate material of construction from that of the doll. The main requirement is that they are of sufficient sturdy construction to adequately secured the nail material. Of course, the outer surface of the tracks 23 and 27 are preferably flesh colored to appear as the skin normally surrounding a nail on either side. Further, the tracks 23 and 27 preferably have a clearance between the top and bottom portions thereof which is substantially equivalent to the thickness of the material of the nail material 3. This accommodates a snug friction fit of the nail material within the tracks. Additionally, with the tracks 23 and 27 being of a resilient material, the friction fit is further enhanced.

The construction of the doll itself need not be restricted in material, shape, or form, the only requirement being that the hands, arms, feet, and legs be of hollow construction so as to allow the unexposed nail material 3 to extend therein.

It is also contemplated as a portion of the invention herein that the concept of doll hands having extendable and dispensable nails to be extended to life size hands of similar character. In this instance, the life size hands and attached arm portions would be hollow, capable of receiving the hands and arms of a child. Indeed, if constructed of appropriate size, the embodiment of FIG. 1 would be of such nature. In this case, a child may "wear" the hands and arms by placing her own therein, affording her playmate the opportunity to give her a manicure without the inherent dangers to the child of trimming, cutting, and polishing. It will be appreciated that the concept of the invention as it relates to life size hands is the same as that for the doll hands, the only significant difference being that of size.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be had to the appended claims.

What is claimed is:

1. A doll having extendable nails, comprising:

a doll body having hollow fingers, hands, toes and feet;

nail material disposed within said fingers and toes for forming nails thereon;

a pair of nail tracks positioned on either side of a respective said finger or toe through which slides and which frictionally secures the associated nail material;

means for extending said nails including at least a pair of pinch rollers secured within said hand or foot of said doll;

an electric motor driving said pinch rollers;

a battery to power said motor; and a switch to activate and deactivate said motor.

2. A doll, according to claim 1, wherein said means for extending said nails consists of:

a plurality of pinch rollers secured within said hand or foot of said doll, each finger or toe having a separate pair of pinch rollers;

a plurality of electric motors driving said pinch rollers, each pair of pinch rollers having a separate motor;

a battery to power said plurality of motors;

a plurality of switches, each motor having its own switch for activation and deactivation.

3. A doll, according to claims 1 or 2, wherein said battery is located within said doll.

4. A doll, according to claim 3, wherein said nails may be painted.

5. A doll, according to claim 4, wherein the tips of said nails may be cut-off and unused nail material exposed.

6. A doll, according to claim 5, wherein said feet of said doll contain a false heel to guide said nail material to the interior of said doll's leg from said doll's toe.

7. A doll, according to claim 6, wherein the upper surfaces of said toes and said fingers are curvate and the exposed portion of said nail material conforms to said curvate shape.

8. A doll, according to claim 7, wherein replacement lengths of said nail material may be inserted into said toes and said fingers of said doll.

* * * * *